US009863114B2

(12) United States Patent
Kaufman et al.

(10) Patent No.: US 9,863,114 B2
(45) **Date of Patent: *Jan. 9, 2018**

(54) INTERLOCKING, SELF-ALIGNING AND TORQUE TRANSMITTING COUPLER ASSEMBLY, SYSTEMS AND METHODS FOR CONNECTING, INSTALLING, AND SUPPORTING FOUNDATION ELEMENTS

(71) Applicant: PIER TECH SYSTEMS, LLC, Chesterfield, MO (US)

(72) Inventors: Kevin Kaufman, Des Peres, MO (US); Michael D. Wilkis, Ellisville, MO (US)

(73) Assignee: PIER TECH SYSTEMS, LLC, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/331,189

(22) Filed: Oct. 21, 2016

(65) Prior Publication Data

US 2017/0037590 A1 Feb. 9, 2017

Related U.S. Application Data

(63) Continuation of application No. 14/708,384, filed on May 11, 2015, now Pat. No. 9,506,214.

(51) Int. Cl.
*E02D 5/52* (2006.01)
*E02D 35/00* (2006.01)
(Continued)

(52) U.S. Cl.
CPC ..... *E02D 5/526* (2013.01); *E02D 5/24* (2013.01); *E02D 5/56* (2013.01); *E02D 7/22* (2013.01);
(Continued)

(58) Field of Classification Search
CPC ..... Y01T 403/7026; Y01T 403/7031; Y01T 403/7032; Y01T 403/7033;
(Continued)

(56) References Cited

U.S. PATENT DOCUMENTS 1,469,304 A 10/1923 Hughes
2,141,880 A 12/1938 Satre
(Continued)

FOREIGN PATENT DOCUMENTS

JP H1121882 A 1/1999
JP 2003090035 A 3/2003
JP 2011247056 A 12/2011

OTHER PUBLICATIONS

International Search Report and Written Opinion of International Application No. PCT/US2016/31783, dated Jun. 16, 2016, 11 pages.

*Primary Examiner* — Frederick L Lagman
(74) *Attorney, Agent, or Firm* — Armstrong Teasdale LLP

(57) ABSTRACT

A self-aligning and torque transmitting coupler assembly includes an outer coupler coupled to a first shaft of and an inner coupler coupled to a second shaft. The outer coupler comprises an inner surface having primary and secondary alignment and torque transmitting features, and the inner coupler comprises an outer surface having primary and secondary alignment features. The primary and secondary alignment features are configured to interlock and facilitate alignment of the first and second shafts along a common axis in an exemplary application of a foundation support system.

63 Claims, 6 Drawing Sheets

(51) Int. Cl.

| | |
|---|---|
| ***E21B 17/04*** | (2006.01) |
| ***E21B 17/046*** | (2006.01) |
| ***E02D 5/24*** | (2006.01) |
| ***E02D 5/56*** | (2006.01) |
| ***E02D 7/22*** | (2006.01) |
| ***E02D 27/12*** | (2006.01) |
| ***E02D 27/48*** | (2006.01) |
| ***E04G 23/06*** | (2006.01) |
| *E04G 23/04* | (2006.01) |
| *E02D 5/28* | (2006.01) |

(52) U.S. Cl.
CPC ..... *E02D 27/12* (2013.01); *E02D 27/48* (2013.01); *E02D 35/005* (2013.01); *E04G 23/065* (2013.01); *E21B 17/04* (2013.01); *E21B 17/046* (2013.01); *E02D 5/28* (2013.01); *E04G 23/04* (2013.01); *Y10T 403/7033* (2015.01); *Y10T 403/7035* (2015.01)

(58) Field of Classification Search
CPC ... Y01T 403/7035; E21B 17/02; E21B 17/04; E21B 17/046; E02D 35/00; E02D 35/005; E02D 5/526
See application file for complete search history.

(56) References Cited

U.S. PATENT DOCUMENTS

| | | | |
|---|---|---|---|
| 2,708,828 | A | 5/1955 | Pruyn |
| 2,819,879 | A | 1/1958 | Beck |
| 2,890,900 | A | 6/1959 | Williamson, Jr. et al. |
| 3,119,635 | A | 1/1964 | Dealy et al. |
| 3,637,238 | A | 1/1972 | Grosch |
| 3,948,545 | A | 4/1976 | Bonds |
| 3,953,981 | A | 5/1976 | Axelsson et al. |
| 4,668,119 | A | 5/1987 | Galletti |
| 4,790,571 | A | 12/1988 | Montanari et al. |
| 5,050,691 | A | 9/1991 | Moses |
| 5,707,180 | A | 1/1998 | Vickars et al. |
| 5,839,524 | A | 11/1998 | Sanford |
| 5,950,744 | A | 9/1999 | Hughes |
| 6,168,213 | B1 | 1/2001 | Muller |
| 6,183,167 | B1 | 2/2001 | Ruiz et al. |
| 6,409,221 | B1 | 6/2002 | Robinson et al. |
| 6,468,003 | B2 | 10/2002 | Merjan et al. |
| 6,551,030 | B1 | 4/2003 | Curry |
| 6,682,267 | B1 | 1/2004 | Jones |
| 6,814,525 | B1 | 11/2004 | Whitsett |
| 7,037,045 | B2 | 5/2006 | Jones |
| 7,073,980 | B2 | 7/2006 | Merjan et al. |
| 7,220,081 | B1 | 5/2007 | Gantt, Jr. |
| 7,226,090 | B2 | 6/2007 | Hughes |
| 7,314,335 | B2 | 1/2008 | Whitsett |
| 7,354,224 | B2 | 4/2008 | Cinquano |
| 7,390,032 | B2 | 6/2008 | Hughes |
| 7,416,367 | B2 | 8/2008 | St. Onge et al. |
| 7,736,095 | B2 | 6/2010 | Fujita |
| 7,744,316 | B2 | 6/2010 | Kaufman |
| 7,854,451 | B2 | 12/2010 | Davis, II |
| 7,914,236 | B2 | 3/2011 | Neville |
| 8,298,633 | B1 | 10/2012 | Chen |
| 8,336,937 | B2 | 12/2012 | Farrow |
| 8,458,984 | B2 | 6/2013 | Marshall |
| 8,506,206 | B2 | 8/2013 | Desmeules |
| 8,517,640 | B2 | 8/2013 | Kasprick et al. |
| 8,662,794 | B2 | 3/2014 | Atchley et al. |
| 8,671,627 | B2 | 3/2014 | Marshall |
| 8,777,520 | B2 | 7/2014 | Lin |
| 8,888,413 | B2 | 11/2014 | Seider et al. |
| 8,926,228 | B2 | 1/2015 | Stroyer |
| 9,127,513 | B2 | 9/2015 | Matthais |
| 9,133,968 | B2 | 9/2015 | Elrick et al. |
| 9,366,084 | B2 | 6/2016 | Queen |
| 9,453,318 | B2 | 9/2016 | Kemp et al. |
| 9,506,214 | B1 * | 11/2016 | Kaufman ..... E02D 5/526 |
| 9,512,589 | B1 | 12/2016 | Van Polen et al. |
| 2003/0075923 | A1 | 4/2003 | Lepoutre |
| 2004/0047693 | A1 | 3/2004 | Nishiwaki et al. |
| 2004/0076479 | A1 | 4/2004 | Camilleri |
| 2007/0045007 | A1 | 3/2007 | Tjader |
| 2011/0180273 | A1 | 7/2011 | Hughes et al. |
| 2011/0188928 | A1 | 8/2011 | West et al. |
| 2016/0186402 | A1 | 6/2016 | Tomchesson et al. |
| 2016/0230364 | A1 | 8/2016 | Stroyer |
| 2016/0230478 | A1 | 8/2016 | Dietz |

* cited by examiner

INTERLOCKING, SELF-ALIGNING AND TORQUE TRANSMITTING COUPLER ASSEMBLY, SYSTEMS AND METHODS FOR CONNECTING, INSTALLING, AND SUPPORTING FOUNDATION ELEMENTS

CROSS REFERENCE TO RELATED APPLICATIONS

The present application is a continuation application of U.S. patent application Ser. No. 14/708,384 filed May 11, 2015, the complete disclosure of which is hereby incorporated by reference in its entirety.

BACKGROUND OF THE INVENTION

The present invention relates generally to coupler assemblies for connecting first and second structural elements, and more specifically to an interlocking, self-aligning and torque transmitting coupler assembly for connecting foundation elements in building structure foundation support systems and related methods for assembling and installing foundation support systems.

Foundation support stability issues are of concern in both new building construction and in maintenance of existing buildings. While much attention is typically paid to the fabrication of a foundation in new construction to adequately support a building structure, on occasion foundation support systems are desired to accomplish the desired stability and prevent the foundation from moving in a way that may negatively affect the structure. As buildings age and settle there is sometimes a shifting of the foundation that can cause damage to the building structure, presenting a need for lifting or jacking the foundation to restore it to a level position where repairs to the structure can be made and further damage to the building structure is prevented. Numerous foundation support systems and methods exist that may capably provide the desired foundation stability and/or may capably lift building foundations to another elevation where they may be optimally supported. Existing foundation support systems and methods typically include a pier or piling driven into the ground proximate a building foundation, leaving a piling projecting upwards on which a support element or lifting element may be attached.

Existing foundation support systems and methods are, however, disadvantaged in some aspects. For example, it is sometimes necessary to extend the length of a piling by connecting an extension piece when conditions are such that a pier is driven deeply into the ground to provide the desired amount of support. Attaching the piling an extension piece in some existing support systems involves a coupler having fastener holes that is attachable to both the piling and the extension piece.

Because the extension pieces may be many feet long and tend to be relatively heavy it is often quite difficult to complete the desired connections with the proper alignment of the fastener holes in the coupler and the fastener holes in the extension piece so that the connection can be completed by installing a fastener through the aligned holes. If the connections are not properly aligned to make the connection, the integrity of the support system to provide the proper level of support can be compromised and system reliability issues can be presented. Accordingly, the needs of the marketplace have not been completely met with existing building foundation support systems.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
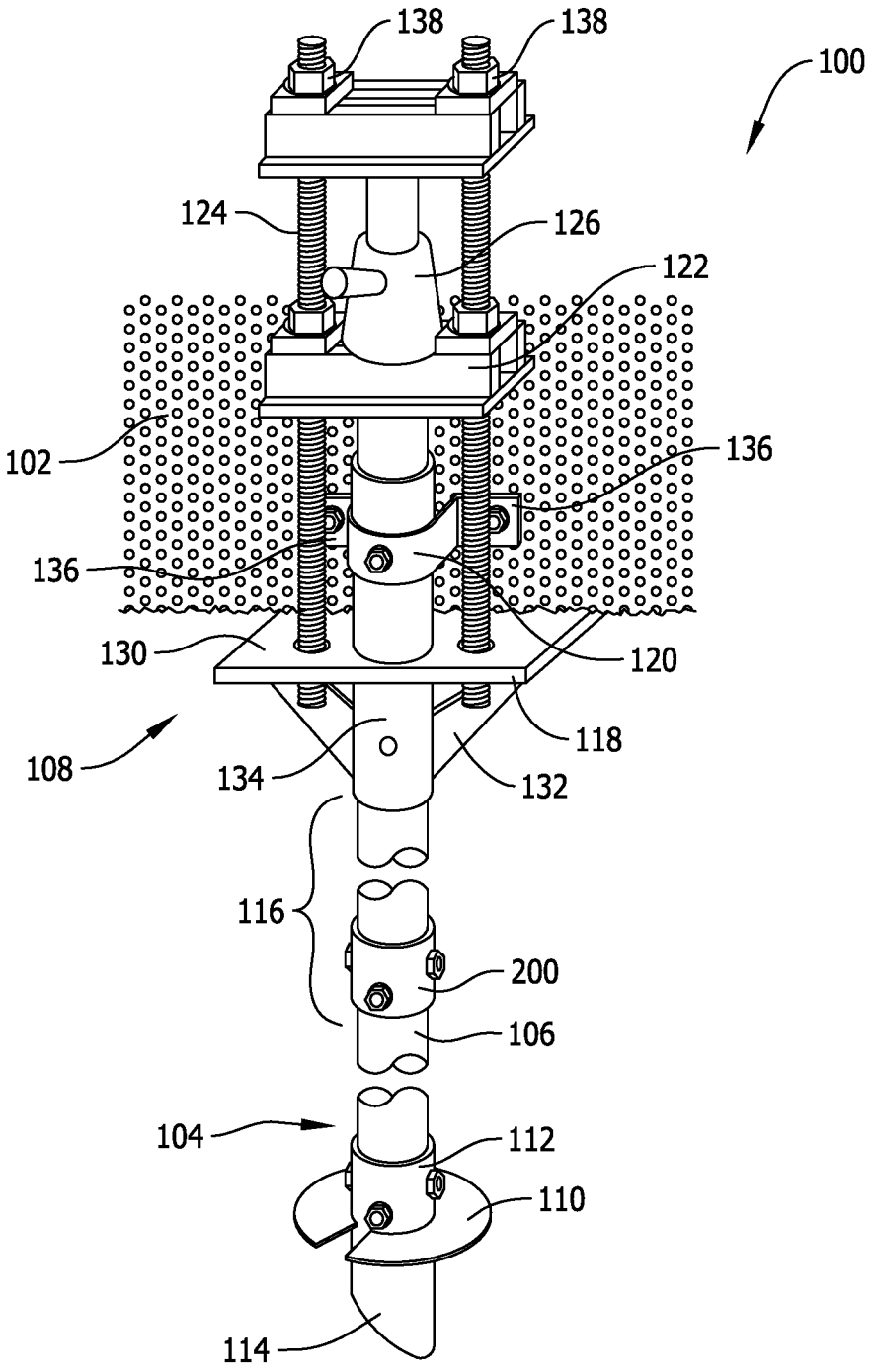
FIG. 1 illustrates a perspective view of one embodiment of a foundation support system interacting with a building structure.

Exemplary embodiments of interlocking, self-aligning coupler assemblies to connect structural elements such as foundation elements of a foundation support system and related methods of assembling, connecting installing and supporting building foundation elements are described that address certain problems and disadvantages in the art. As described below, an interlocking self-aligning and torque transmitting coupler assembly of the present invention facilitates a simplified alignment and connection between, for example, a piling and an extension piece during assembly of a building foundation support system, while ensuring that an adequate lifting strength and support is reliably established by avoiding installation issues that can otherwise be problematic when subjected to torque to drive the pilings deeper into the ground. Foundation support elements may therefore be assembled more quickly and more reliably while reducing labor costs and simultaneously improving system reliability by avoiding problematic torque-related issues that can otherwise cause elements of a foundation support system to deform and negatively impact the stability of the system and its load bearing capacity.

More specifically, the support system described herein includes an interlocking, self-aligning, torque transmitting coupler assembly that includes first and second couplers and a plurality of mating alignment and torque transmission features provided in each coupler that assist in attaching first and second structural elements to each other with relative ease while ensuring proper alignment of the connections made, including but not limited to connections between foundation elements in a foundation support system. Multiple and different features are provided in each coupler in the coupler assembly that serve dual purposes of facilitating alignment and reliable connection of foundation elements in the field, as well as to more effectively transmit torque between the foundation elements after the aligned connections are established.

In a contemplated embodiment, the inventive coupler assembly includes a first or inner coupler attached to a first foundation element including a first shaft and an outer coupler attached to a second foundation element including a second shaft. The inner coupler includes a pair of primary alignment and torque transmitting ribs formed on a round outer surface thereof that are configured to be slidably inserted into a respective pair of primary alignment and torque transmitting grooves formed in a round inner surface of the outer coupler. As such, when the first and second foundation elements are desired to be attached, the inner coupler is inserted partly into the outer coupler and rotated about its center axis until the primary alignment and torque transmitting ribs of the inner coupler align and mate with the primary alignment and torque transmitting grooves of the outer coupler where complete mating engagement of the inner and outer couplers may occur. Only when the alignment and torque transmitting features are fully mated can the inner coupler be completely received in the outer coupler to complete a connection between the first and second shafts while also effectively mechanically isolating any fasteners provided from torque as a foundation support system is installed. By virtue of the inventive coupler assembly, torsional force applied to one of the foundation elements is transmitted to the other by the engagement of the torque transmission features formed in the inner and outer couplers.

In another contemplated embodiment, a fastened connection of the inner and outer couplers may include a cross-bolt connection wherein first and second bolts respectively extend through pairs of fastener holes or fastener openings formed in the respective inner and outer coupler. The fastener holes are self-aligning when the inner and outer couplers are completely engaged and the first and second bolts extend in mutually perpendicular directions through the fastener holes. The first and second bolts also extend at offset elevations to one another in the coupler assembly. Advantageously, no fastener holes in the pile and extension piece are needed to make the cross-bolt connection via the inner and outer coupler. Alignment difficulties associated with fastener holes in the pile and extension piece are completely avoided.

In other contemplated embodiments, however, a single fastener may be utilized to complete a connection between the first and second shafts through the coupler assembly and as such a single pair of fastener holes may be provided in each of the inner and outer couplers that are self-aligning when the inner and outer couplers are engaged.

In still another contemplated embodiment the mechanical connection between the shafts may be completed without using any fasteners via the interlocking alignment and torque transmitting features formed in the inner and outer couplers.

As described in further detail below, an exemplary embodiment of a coupler assembly is self-aligning and self-locking in a manner that enables quick and easy coupling of first and second shafts, and in some cases accommodates a sturdy and easily accomplished cross-bolt fastening connection between the first and second shafts in a desirable manner. Any torque imparted onto the coupled shafts via twisting of the upper shaft is contained within interlocking features of the coupler assembly as opposed to being transferred through bolted connections between the shafts in conventional support systems. Method aspects of the inventive concepts will be in part apparent and in part explicitly discussed in the following description.

FIG. 1 illustrates a perspective view of an exemplary embodiment of a foundation support system 100 interacting with a building foundation 102 of a structure. The foundation support system 100 may interact with new foundation upon which a structure is to be built, or may alternatively interact with a foundation supporting an existing structure. That is, the foundation support system 100 may be applied to new building construction projects as well as to existing structures for maintenance and repair purposes. Of course, the support system 100 may alternatively be used to support an object other than a building foundation as desired.

After determining, according to known engineering methodology and analysis, how the foundation 102 or other structure needs to be supported, primary piles or pipes (hereinafter collectively referred to as a "pile" or "piles") 104 of appropriate size and dimension may be selected and may be driven into the ground or earth at a location proximate or near the foundation 102 using known methods and techniques. The primary piles 104 typically consist of a long shaft 106 driven into the ground, upon which a support element such as a plate or bracket (not shown) or a lifting element such as the lifting assembly 108 is assembled. The shaft 106 of the primary pile 104 may include one or more lateral projections such as a helical auger 110. The piles 104 may be, for example, helical steel piles available from Pier Tech Systems (www.piertech.com) of St. Louis, Mo., although other suitable piles available from other providers may likewise be utilized in other embodiments.

The helical auger 110 may in some embodiments be separately provided from the piling 104 and attached to the piling 104 by welding to a sleeve 112 including the auger 110 provided as a modular element fitting. As such, the sleeve 112 of the modular fitting is slidably inserted over an end of the shaft 106 of the piling shaft 104 and secured into place, for example with fasteners such as the bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly, as described in further detail below. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 (comprising allthread rods, for example) and accompanying hardware. In another suitable embodiment the lifting assembly 108 may also include a jack 126 and a jacking block 128. Suitable lifting assemblies may correspond to those available from Pier Tech Systems (www.piertech.com) of St. Louis, Mo., including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned and to accommodate one of the primary pile 104 or an extension pile 116. The housing 134 is generally perpendicular to the surface of lift plate 110 and extends above and below the plane of lift plate 130.

In the exemplary embodiment shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the exemplary embodiment, the bracket clamps 120 include a generally Ω-shaped piece having a center hole at the apex of the "Ω" to accommodate a fastener. The Ω-shaped bracket clamp 120 includes ends 136, extending laterally, that include openings to accommodate fasteners. The fasteners extending through the openings in the ends 136 are attached to the foundation 102, while the fastener extending through the center opening at the apex of the "Ω" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternately, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of St. Louis, Mo. and other providers, any of which may be utilized in other embodiments of the foundation support system.

As shown in FIG. 1, the exemplary foundation support system 100 includes a coupler assembly 200 according to an embodiment of the present invention that establishes a mechanical connection between the shaft 106 of the primary pile 104 and the shaft of the extension pile 116. It is appreciated, however, that more than one coupler assembly 200 may be utilized to connect another extension pile 116 to the extension pile 116 shown 200 or to mechanically connect other ones of the foundation elements 112, 134 to the respective piles 104 and 116 shown and described above. Further, it should be appreciated that the coupler assembly 200 may be utilized in a foundation support system 100 that does not include an extension pile 116. For example, the coupler assembly 200 could establish a connection between the pile 104 and the housing 134, or between the pile 104 and the sleeve 112 of the modular fitting. The connector assembly 200 may accordingly facilitate a modular assembly of the foundation elements shown and described in various combinations.

Figure 2:
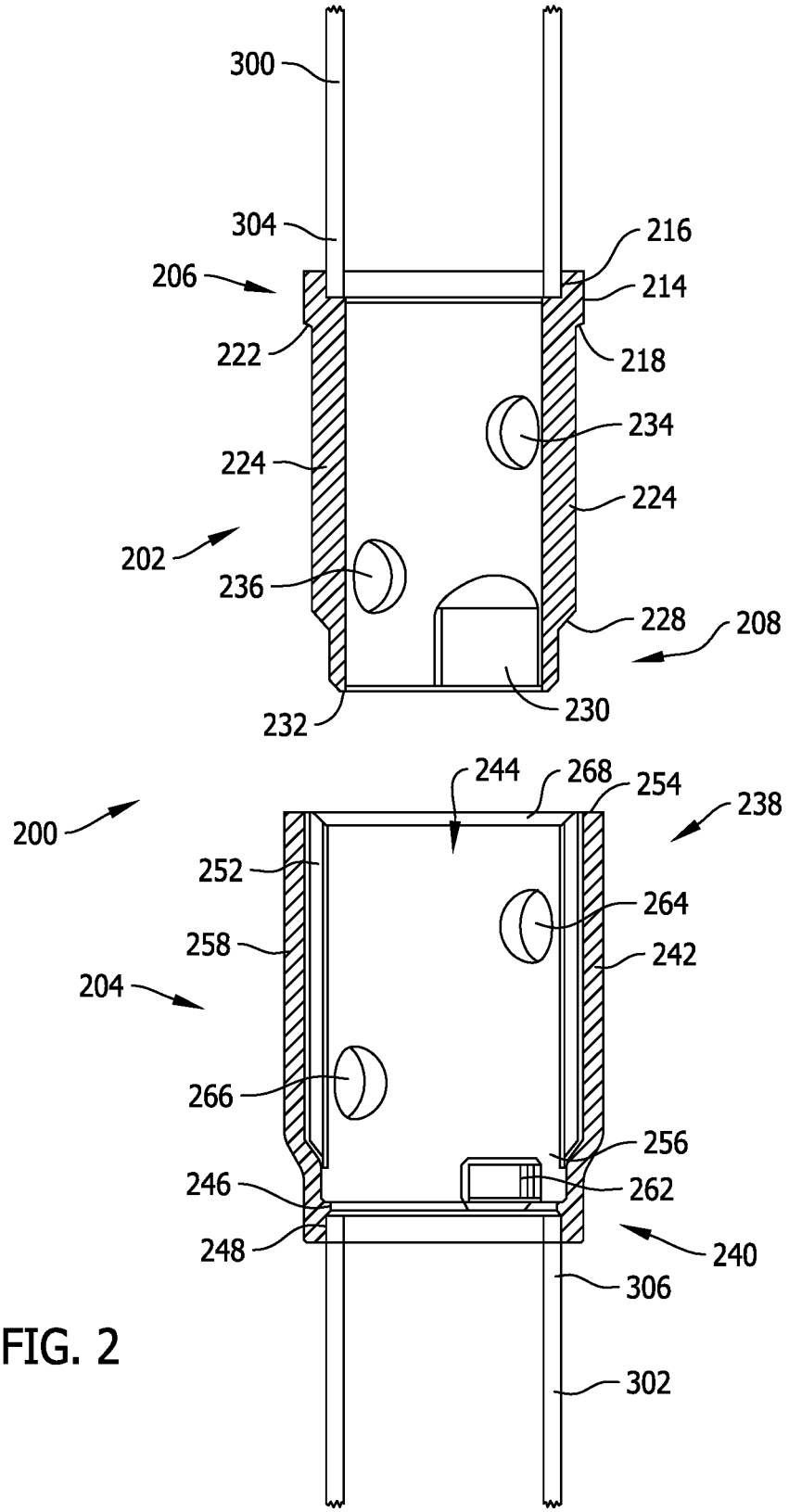
FIG. 2 shows a cross-sectional view of a piling assembly for the system shown in FIG. 1 including a coupler assembly according to an embodiment of the present invention and including an inner coupler and an outer coupler.

FIG. 2 shows the coupler assembly 200 in cross-sectional view wherein the coupler assembly 200 is seen to include an inner coupler 202 attached to a shaft of a first piling 300 and an outer coupler 204 attached to a shaft of a second piling 302. In one embodiment, pilings 300 and 302 include a length of pipe fabricated from a metal such as steel. The couplers 202, 204 may likewise be integrally formed from a metal material such as steel according to known techniques to include the features described. The first piling 300 may be of the same dimension in terms of its inner and outer diameter and correspond in cross sectional shape to the second piling 302, to which it is attached. Alternatively stated, the pilings 300, 302 being connected via the coupler assembly 200 are constructed to be the same, albeit with possibly different lengths, although this not necessarily required in all embodiments. The cross-sectional shape of the pilings 300, 302 can be circular, square, hexagonal, or another shape as desired. The pilings 300, 302 can be made to different lengths, however, as the application requires, and the pilings 300, 302 can be hollow or filled with a substance such as concrete or another known suitable substance familiar to those in the art.

In the exemplary embodiment shown, the first piling 300 may correspond to an extension piling, such as the extension piling 116 shown in FIG. 1, and the second piling 302 may correspond to a primary piling, such as the primary piling 104 shown in FIG. 1. As noted above, the coupler assembly 200, however, may alternatively be used to connect other shafts of other foundation elements in the foundation support system 100 previously described, or still further may be utilized to connect other structural shaft elements in another application apart from foundation support. In the exemplary embodiment shown, the shaft of the first piling 300 includes a distal end 304, to which is coupled the inner coupler 202, and the shaft of the second piling 302 includes a distal end 306, to which is coupled the outer coupler 204. The distal ends 304 and 306 are positioned adjacent each other such that the inner coupler 202 is configured to be at least partially inserted into the outer coupler 204, as described in further detail below.

Figure 3:
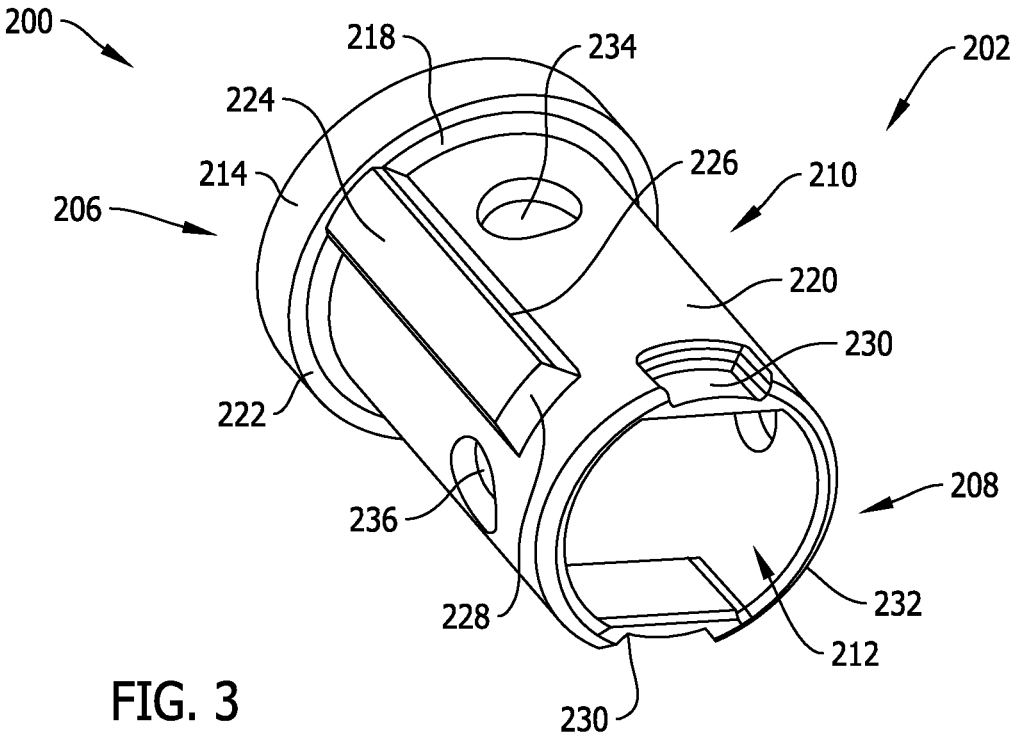
FIG. 3 illustrates a perspective view of an inner coupler of the coupling assembly shown in FIG. 2.
Figure 4:
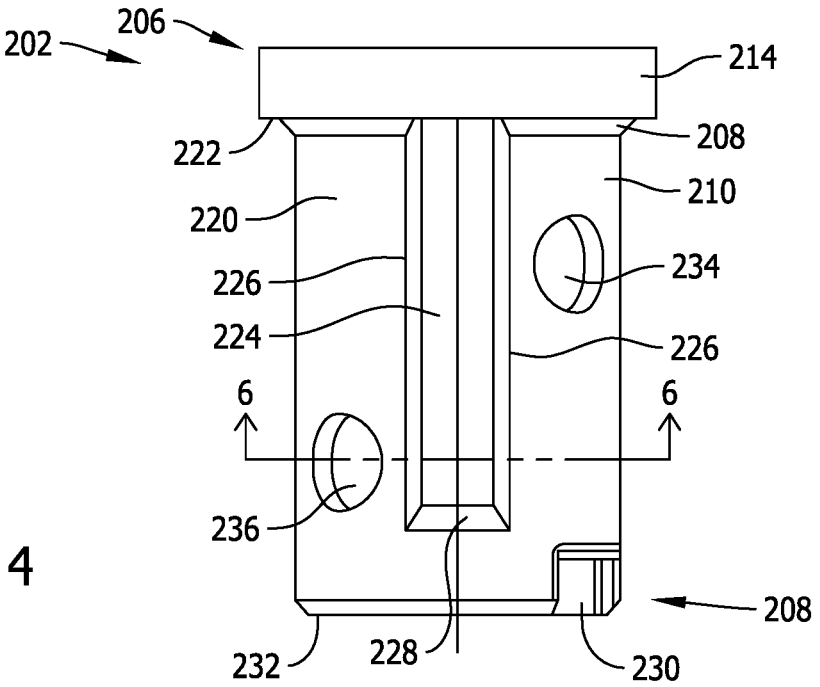
FIG. 4 illustrates a side view of the inner coupler shown in FIG. 3.
Figure 5:
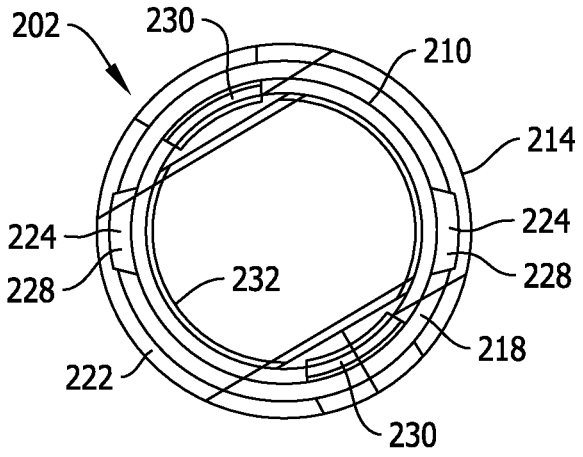
FIG. 5 illustrates a bottom view of the inner coupler shown in FIG. 3.
Figure 6:
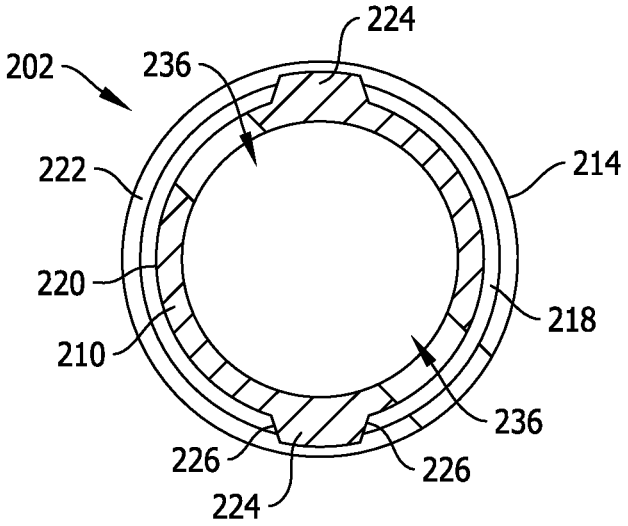
FIG. 6 illustrates a cross-sectional view of the inner coupler taken along line 6-6 in FIG. 4.

FIGS. 3, 4 and 5 respectively illustrate a perspective view, bottom view and rear cross-sectional of the inner coupler 202 of the coupler assembly 200 that will be described collectively in the following discussion.

In the exemplary embodiment illustrated, the inner coupler 202 includes a first end 206, a second end 208, and a hollow round body portion 210 extending therebetween. The inner coupler 202 accordingly includes a generally round opening 212 extending therethrough between the ends 206, 208. The first end 206 includes a collar portion 214 including a counter bore 216 configured to receive the distal end 304 of the shaft of the first piling 300. In the exemplary embodiment shown, the counter bore 216 includes an inner diameter or circumference that is sized, shaped and dimensioned to be large enough to accommodate the outer diameter of the shaft of the piling end 300 (FIG. 2) such that when the piling end 304 is inserted into the counter bore 216 the end of the shaft is received in the counter bore 216. In an alternative embodiment, the outer diameter of the collar 214 may be selected to be small enough to fit within the inner diameter of the shaft of the piling end 300. Regardless, the shaft of the first piling 300 is fixedly attached to the inner coupler 202 by any known means, such as, but not limited to, welding. As previously mentioned, the shaft may include a round cross-section, a square cross-section, or another cross-sectional shape, and accordingly the end 206 of the inner coupler 202 has a complementary round shape, square shape or other shape to facilitate the connection of the shaft end to the counter bore 216.

As further seen in the figures, the body portion 210 of the inner coupler 202 is attached to the collar 214 via a seating surface 218. More specifically, the seating surface 218 obliquely extends between an outer surface 220 of the body portion 210 and a lip surface 222 of the collar 214.

The inner coupler 202 also includes a pair of axially extending ribs 224 that project or extend radially outward from the round outer surface 220 of the body portion 210. In the exemplary embodiment, the axially extending ribs 224 are positioned opposite each other on the round body 210 of the inner coupler 202. That is, the ribs 224 are extended about 180° from one another on an outer surface of the round body 210, and extend lengthwise or in a direction parallel to a longitudinal axis of the shafts that are connected with the coupler assembly.

In another suitable embodiment, the ribs 224 are positioned at any point on the round body 210 that facilitates operation of the coupler assembly 200 as described herein. Each rib 224 includes a pair of side surfaces 226 and a seating surface 228 that each extends obliquely from round outer surface 220 of the body 210. The ribs 224 serve as a primary alignment feature to align the inner coupler 202 with the outer coupler 204 to enable connecting the first piling 300 to the second piling 302 as well as a primary torque transmitting feature when the inner coupler 202 is mated to the outer coupler 204. More specifically, the pair of ribs 224 are configured to cooperatively engage a pair of grooves defined in the outer coupler 204 to accomplish alignment and torque transmission, as described in further detail below. While a pair of ribs 224 are shown, it is understood that greater or fewer number of ribs may likewise be provided in further and/or alternative embodiments.

In the exemplary embodiment shown, the inner coupler 202 also includes a secondary alignment and torque transmission feature that includes a pair of circumferentially extending recesses 230 defined in the round body 210 proximate the second end 208 of the inner coupler 202. Specifically, the circumferential recesses 230 extend from an end surface 232 of the inner coupler second end 208 partly around the circumference of the body 210. Similar to the ribs 224, the recesses 230 are configured to engage a pair of projections defined in the outer coupler 204, as described in further detail below. Further, the recesses 230 are circumferentially offset from the ribs 224, such that the recesses 230 and the ribs 224 are not aligned with one another. In another suitable embodiment, the recesses 230 may be circumferentially aligned with the ribs 224 if desired. While a pair of circumferential recesses 230 are shown, it is understood that greater or fewer number circumferential recesses 230 may likewise be provided in further and/or alternative embodiments. As best seen in FIG. 5, at the locations of the circumferential recesses 230, the inner surface of the coupler 202 includes flat regions that maintain a desired wall thickness in the coupler body 210. As such, inner surface of the coupler 202 in cross-section seen in FIG. 5 includes two rounded curve portions separated by straight or linear portions at the locations of the recesses 230 whereas the inner surface of the coupler 202 is otherwise uniformly round and circular in cross section at other locations in the body 210 as shown in the figures.

The inner coupler body portion 210 in the example illustrated also is formed with one or more pairs of fastener holes or openings 234, 236 defined therethrough to allow for fastening of the inner coupler 202 and the outer coupler 204. The two openings 234 are shown on opposite sides or locations in the round body portion 210 such that a fastener such a bolt extending through the openings 234 will be generally perpendicular to the longitudinal axis and will enter and leave the body portion 210 approximately normal to the round outer surface 220. In a further embodiment, the body portion 210 includes the first pair of openings 234 proximate the first end 206 and a second pair of openings 236 located proximate the second end 208. The pairs of openings 234 and 236 are angularly offset from one another by 90° such that fasteners inserted into the openings 234 and 236 are mutually perpendicular to one another when received through the respective openings 234, 236. This particular configuration is sometimes referred to as a cross-bolt connection and is shown in FIG. 1 wherein the coupler assembly 200 connects the shafts 106 and 116.

Figure 7:
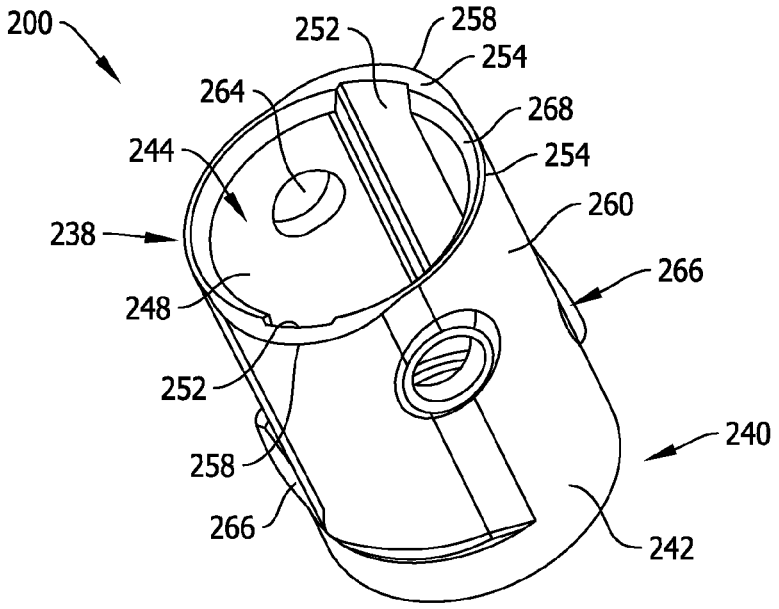
FIG. 7 illustrates a perspective view of the outer coupler shown in FIG. 2.
Figure 8:
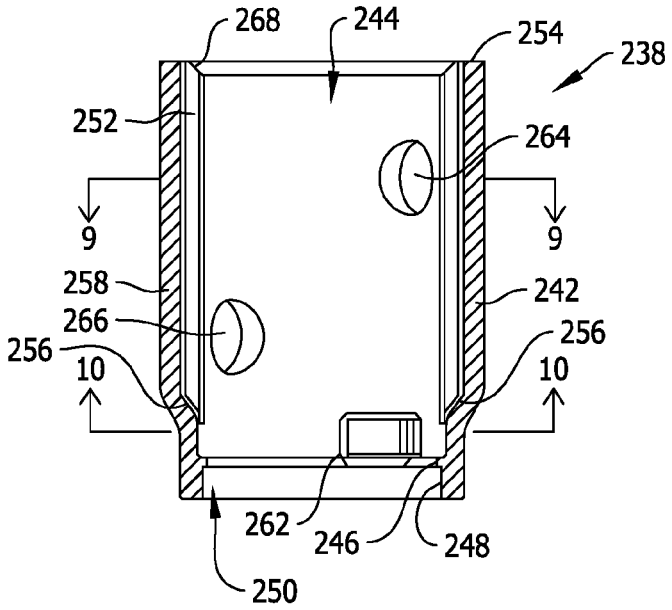
FIG. 8 illustrates a cross-sectional view of the outer coupler shown in FIG. 7.
Figure 9:
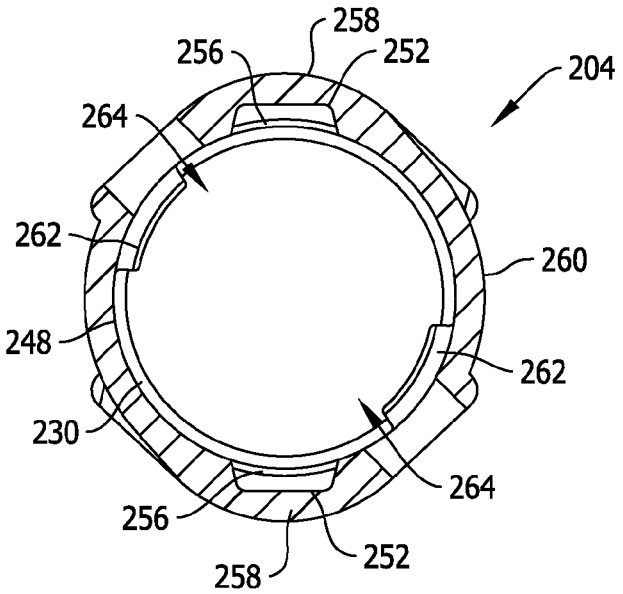
FIG. 9 illustrates a cross-sectional view of the outer coupler taken along line 9-9 in FIG. 8.
Figure 10:
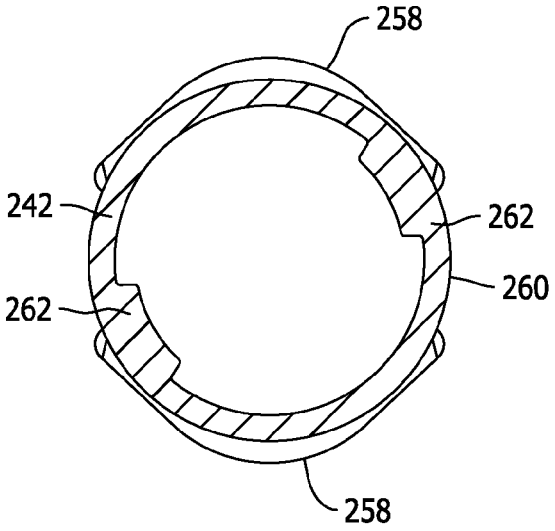
FIG. 10 illustrates a cross-sectional view of the outer coupler taken along line 10-10 in FIG. 8.

FIG. 7 illustrates a perspective view of the outer coupler 204 of the coupling assembly 200 that may be used with the foundation support system 100 shown in FIG. 1 and the inner coupler 202 shown in FIGS. 3-6. FIG. 8 illustrates a cross-sectional view of the outer coupler 204. FIG. 9 illustrates a cross-sectional view of the outer coupler 204 taken along line 9-9 in FIG. 8. FIG. 10 illustrates a cross-sectional view of the outer coupler 204 taken along line 10-10 in FIG. 8. The following discussion shall collectively refer to FIGS. 7-10.

In the exemplary embodiment shown, the outer coupler 204 includes a first end 238, a second end 240, and a hollow round body portion 242 extending therebetween. The outer coupler 204 accordingly includes an opening 244 extending between ends 238 and 240. As shown in FIG. 8, the second end 240 includes a flange 246 extending from an inner surface 248 of the round body 242. The flange 246 defines a cavity 250 at the second end 240 that configured to receive the distal end 306 of the shaft of the second piling 302. In the exemplary embodiment, the cavity 250 includes an inner diameter that is large enough to accommodate the outer diameter of the shaft at the piling end 306 such that the shaft of the piling end 306 is inserted in to the cavity 250 to join the outer coupler 204 with the second piling 302. In another suitable embodiment, at least a portion of the outer diameter of the second coupler body 242 is small enough to fit within the inner diameter of shaft of the piling end 306. The shaft of the second piling 302 is fixedly attached to the second end 240 of the outer coupler 204 by any known means, such as, but not limited to, welding. As previously mentioned, the shaft of the second piling 302 may include a round cross-section, a square cross-section, or another cross-sectional shape, and accordingly the end 240 of the outer coupler 204 has a complementary round shape, square shape or other shape to facilitate the connection of the shaft end to the coupler 204. It should also be noted here that the couplers 202, 204 may be configured to receive and connect to shafts having different cross sectional shapes as desired in further and/or alternative embodiments.

The outer coupler 204 also includes a pair of axially extending grooves 252 that are formed in the round inner surface 248 and extend from a first end surface 254 toward the second end 240. In the exemplary embodiment, the grooves 252 are positioned opposite each other on the body 242 of the outer coupler 204. In another suitable embodiment, the grooves 252 are positioned at any point on the body 242 that facilitates operation of the coupler assembly 200 as described herein. The grooves 252 are configured to receive the pair of ribs 224 of the inner coupler 202 as a primary alignment feature with the inner coupler 202 to more easily connect the shaft of first piling 300 to the shaft of the second piling 302, as well as transmit torque in a manner contained within the coupler assembly. Each groove 252 includes a seating surface 256 proximate the second end 240 that is configured to mate with the seating surface 228 on a rib 224 of the inner coupler 202, as described in further detail below.

In the exemplary embodiment, the outer coupler 204 also includes a pair of wings or flares 258 that extend outward from a round outer surface 260 of the outer coupler body 242. Each wing or flare 258 is positioned approximate the respective groove 252 such that the wings or flares 258 facilitate a substantially constant thickness of the outer coupler body 242. Each wing or flare 258 extends from the end surface 254 toward the second end 240 and terminates at approximately the same axial position at the groove 252. The wings or flares 258 impart a rounded outer surface having a discontinuous outer diameter in the outer surface of the outer coupler 204. As seen in the cross sections of FIGS. 9 and 10, the outer coupler has an eccentric, complex curvature and elliptical shape where the rings or flares 258 reside.

The outer coupler 204 also includes a secondary alignment and torque transmission feature that includes a pair of circumferential projections in the form of tabs 262 extending outwardly from the round body portion 242 proximate the second end 240. Specifically, the circumferential projections 262 extend radially inward from the inner surface 248 proximate the flange 246. The circumferential projections 262 are configured to engage the pair of circumferential recesses 230 defined in the inner coupler 202 when the coupler assembly 200 is assembled. Further, the circumferential projections 262 are circumferentially offset from the grooves 252 in the outer coupler, such that the projections 262 and the grooves 252 are not aligned. In another suitable embodiment, the projections 262 may be circumferentially aligned with the grooves 252.

Additionally, the outer coupler body portion 242 may be formed with one or more pairs of fastener holes or openings 264, 266 defined therethrough to allow for joining of the outer coupler 204 to the inner coupler 202. Two openings 264 may be formed on opposite sides of the body portion 242 such that a fastener extending through openings 264 will be generally perpendicular to the longitudinal axis and will enter and leave the body portion 242 approximately normal to the surface 260. In a preferred embodiment, the body portion 242 includes the first pair of openings 264 proximate the first end 238 and a second pair of openings 266 located proximate the second end 240. The pairs of openings 264 and 266 are preferably rotationally offset from one another by 90° such that fasteners inserted into the openings 264 and 266 are perpendicular to one another when coupler assembly 200 is viewed in cross-section. This orientation of fastener holes facilitates a cross-bolt connection as described above.

As mentioned above, however, the cross-bolt connection is not required in all embodiments, however, and instead one fastener may be employed to complete a connection with the coupler assembly 200 in another embodiment. Still further, a mechanical connection may be completed without a fastener at all in certain applications as explained further below.

Although the inner coupler 202 is shown and described herein as including ribs 224 and outer coupler 204 is described herein as having grooves 252, it is contemplated that this arrangement of features may be reversed and/or combined in another embodiment. That is, in an alternative embodiment the inner coupler 202 may include grooves instead of or in addition to ribs 224, and the outer coupler 204 may likewise include ribs instead of or in addition to grooves 252. Further, the inner coupler 202 may include at least one of each a rib and a groove, while outer coupler may include a corresponding rib and a corresponding groove. Similarly, although the inner coupler 202 is described herein as including the circumferential recess 230 and the outer coupler 204 is described herein as having the circumferential projection 262, it is contemplated that the inner coupler 202 may include a circumferential projection instead of or in addition to the circumferential recess 230, and that the outer coupler 204 may include a circumferential recess instead of or in addition to projection 262. Generally, the inner coupler 202 includes at least one alignment and torque transmission feature that is configured to engage with a corresponding alignment and torque transmission feature of the outer coupler 204 to facilitate alignment of the couplers 202 and 204 to couple shafts of different foundation elements in the foundation support system.

Further, although ribs 224 and grooves 262 are shown as substantially linear, axially extending features oriented in parallel with the longitudinal axis of the shafts of the piles to which they are coupled, it is contemplated that the ribs 224 and grooves 262 may be in a non-parallel orientation with respect to the longitudinal axis of the shafts of the piles, such as obliquely-oriented. Additionally, it is contemplated that ribs 224 and grooves 262 may be non-linear in nature and form a curved shape such as, but not limited to, a spiral shape about their outer and inner surfaces of the respective couplers 202 and 204.

Referring again to FIG. 2, the coupler assembly 200 facilitates connecting the shaft of the first piling 300 with the shaft of the second piling 302. As described above, the first piling 300 may be an extension piling 116 (shown in FIG. 1).

The second piling 302 may be one of the primary piling 104 (shown in FIG. 1) or an extension piling 116.

In another suitable embodiment, the coupler assembly 200 may be utilized to connect any two structural shaft components and is not restricted to use within a foundation support system 100, as described herein. That is, the shafts being connected with the coupler assembly 200 need not be shafts of piles or piers or any of the components shown and described in the foundation support system described above, but instead other structural elements for other purposes. Provided that the ends of the structural elements being connected are shaped to fit the counter bores in the inner and outer couplers 202, 204, the structural elements need not even be shafts.

In operation, the inner coupler 202 is fixedly attached to the end 304 of the shaft of the first piling 300 and the outer coupler 204 is fixedly attached to the end 306 of the shaft of the second piling 302. The second end 208 of the inner coupler 202 is then partly inserted into the first end 238 of the outer coupler 204 such that at least a portion of the inner coupler 202 is received within the opening 244. The diameter of the inner coupler 202 at the location of the ribs 244 is larger than the inner diameter of the outer coupler inner surface 248 such that the inner coupler 202 can only be inserted into the outer coupler 204 in a predetermined orientation. More specifically, the diameter of the outer coupler 204 at the location of the grooves 254 is large enough to accommodate the diameter of the inner coupler 202 at the location of the ribs 244. As such, the ribs 224 of the inner coupler 202 must be aligned with the grooves 254 of the outer coupler 204 to assemble the coupler assembly 200. Once the second end 208 of the inner coupler 202 is partially inserted, simple rotation of the first piling 300 causes automatic alignment of the couplers 202 and 204. Because the pile 300 is relatively heavy, the inner coupler 202 once aligned will fall into place via gravitational force as the piling 300 is rotated to the point of alignment. Therefore, the ribs 224 and the grooves 254 serve as a self-alignment feature that makes it easier to connect the pilings 300 and 302 to each other.

Once the ribs 224 are aligned with the grooves 254, the inner coupler 202 may then be removably inserted into the outer coupler 204. Insertion terminates when the lip surface 222 and the seating surface 218 of the inner coupler 202 mate, respectively, with the end surface 254 and a seating surface 268 at the first end 238 of the outer coupler 204. As such, in the exemplary embodiment, the collar portion 214 of the inner coupler 202 remains exposed and is not inserted into the opening 244 of the outer coupler 204. In another suitable embodiment, the inner coupler 202 is fully inserted into the outer coupler 204.

Referring to the second ends 208 and 240, when the ribs 224 are fully inserted into the grooves 254, the seating surface 228 on the ribs 224 is in contact with the seating surface 256 on the grooves 254. Additionally, the end surface 232 on the inner coupler 202 contacts the flange 246 on the outer coupler 204. As such, seating surfaces 218, 268, 228, and 256, end surface 232, and flanges 246 are configured to ensure that the inner coupler 202 is properly positioned within the outer coupler 204 with respect to depth.

Furthermore, each circumferential recess 230 in the second end 208 of the inner coupler 202 receives a circumferential projection tab 262 in the second end 240 of the outer coupler 204 to further ensure proper alignment of the couplers 202 and 204 as well as torque transmission. Over time and through continued usage, it is possible that friction may erode away small portions of the ribs 224. However, the circumferential recesses 230 and projections 262 serve as a secondary alignment and torque transmission feature to facilitate assembly of the coupler assembly 200.

When the combination of alignment features have been properly seated and aligned between the couplers 202 and 204, the first piling 300 is spaced from the second piling 302 by a distance equal to the distance between the counter bore 216 in the inner coupler 202 and the flange 246 in the outer coupler 204. As such, the pilings 300 and 302 are not directly connected to the same component of the coupler assembly 200 and no component of the coupler assembly 200 overlaps both pilings 300 and 302. In such a configuration, any torque imparted onto the support system 100 is contained within the coupler assembly 200 instead of being transferred between the pilings 300 and 302 using fasteners such as bolts extending through fastener holes in the pilings 300 and 302. Advantageously, by virtue of the couplers 202 and 204, the connections can be established between the pilings 300 and 302 without fastener holes and fasteners extending through the pilings 300, 302. As clearly seen in the Figures, the fasteners, when provided extend only through the couplers 202, 204. As such, torque related issues associated with deformation of fastener holes in the pilings 300, 302 that may occur in conventional systems are eliminated by the coupler assembly 200.

More specifically, if the first piling 300 were to be rotated while the inner coupler 202 is positioned within and engaged with the outer coupler 204 to drive the pilings 300, 302 deeper into the ground, the torque is distributed in the coupler assembly 200 between the ribs 224 and the grooves 254, between the circumferential recesses 230 and the circumferential projections 262. Further, because the primary alignment and secondary alignment features described are differently sized and proportions, as well as being offset and spaced apart from one another in the coupler assembly 200, any applied torque is distributed across multiple locations in the coupler assembly 200 where the alignment and torque transmitting features are engaged. Because some of the alignment and torque transmitting features are axially oriented while others are circumferential, a particularly strong and sturdy connection is realized that facilitates torque transfer without deformation of either coupler 202, 204 or the connecting shafts of the piles 300, 302. Finally, because the couplers 202 are each fabricated from high strength steel in a contemplated embodiment, they are capable of withstanding high torsional forces to install a foundation support system by driving piles into the ground. Simpler and easier connections of foundation elements such as piles are therefore realized with improved reliability that likewise facilitates simpler and easier installation of a foundation support system with improved reliability.

Further, in such a configuration, the first pair of fastener holes or openings 234 on the inner coupler 202 is automatically aligned with the first pair of fastener holes or openings 264 on the outer coupler 204 when the couplers 202, 204 are mated. Similarly, the second pair of fastener holes or openings 236 on the inner coupler 202 is automatically aligned with the second pair of fastener holes or openings 266 on the outer coupler 204. As such, a technician can easily insert a first fastener through openings 234 and 264 and a second fastener through openings 236 and 266 to secure the inner 202 to the outer coupler 204 and establish a cross-bolt connection. As such, the coupler assembly 200 configured as shown in the Figures is sometimes referred to as a cross-bolt and cross-lock coupler.

As mentioned above, a single fastener may also be utilized in another embodiment. In such a scenario, one of the pairs of fastener holes may be omitted in the construction of the couplers 202, 204 or only one of the pairs of fastener holes may be utilized to receive a fastener.

In still another embodiment no fasteners may be utilized and the couplers 202, 204 could either be formed without fastener holes at all or the fastener holes provided may simply not be utilized with fasteners. Because the pilings in the example of the foundation support system are driven and loaded with compression force in use, the fastened connection may not be strictly necessary because of the interlocking engagement of the alignment and torque transmission features that may transmit torsional force in the absence of any fasteners. The configuration of the couplers 202, 204 further facilitates direct and distributed transmission of compressive forces by the seating surfaces described on each coupler that mate with one another when the couplers 202, 204 are engaged. The flush engagement of the mating ends when the coupler assembly 200 is fully assembled, in combination with the seating surfaces described, provides a high strength connection in the assembly.

Such a configuration of coupler assembly 200 and shafts of the piles 300 and 302 reduces, and substantially eliminates the stress in the assembly that may otherwise result because of the difficulties in aligning relatively long and heavy pieces in the assembly. If fasteners are intentionally or unintentionally forced through openings that are not completely aligned in adjacent shafts in the assembly the joint between adjacent shafts may be subject to a significant amount of mechanical stress that in conventional systems may lead to deformation of the fastener holes and weakening of the shafts. Because the coupler assembly 200 is self-aligning, however, such issues are avoided.

Additionally, deformation of the fastener holes via unintentional misalignment of piles in conventional support systems may result in some relative movement, sometimes referred to as play, in the coupled connection that can also adversely affect the load bearing capacity of the system. Also, increased stress caused by misalignment of adjacent components may cause a reduction in the effective service life of the piles, thus requiring more frequent replacement. By virtue of the self-aligning and self-locking coupler assembly and system described, these problems are substantially minimized, if not completely eliminated, in most cases where the coupler assembly 200 is properly used. The inter-engagement of the coupler features described, and in particular the alignment and torque transmission features of each coupler 202 and 204, mechanically isolates the fasteners, when provided, from torsional force.

The fasteners, when utilized with fully engaged couplers 202, 204, are further mechanically isolated from compression forces in the coupler assembly 200 when the pilings are driven further into the ground via application of torsional force on and end of an above ground piling. The seating surfaces described in the coupler assembly 200 that bear upon and inter-engage with one another when the coupler assembly 200 is fully engaged, provide direct transmission of compression forces through the couplers 202, 204.

The fasteners provided may, however, realize tension force depending on how the support system is configured and applied More specifically, the fasteners may experience a tensile load from a loading of a pile with a uplift force, or if the pile should need to be removed the fasteners when provided ensure that the connection maintains engagement.

The benefits and advantages of the inventive concepts described herein are now believed to have been amply illustrated in relation to the exemplary embodiments disclosed.

An embodiment of a coupler assembly for connecting a first shaft to a second shaft has been disclosed. The coupler assembly includes: an outer coupler configured to be coupled to the first shaft, the outer coupler comprising an inner surface formed with at least one primary alignment feature and at least one secondary alignment feature; and an inner coupler configured to be coupled to the second shaft, the inner coupler comprising an outer surface formed with at least one primary alignment feature and at least one secondary alignment feature; wherein the primary and secondary alignment features of the outer coupler are respectively configured to engage the alignment features of the inner coupler when the outer surface of the inner coupler and the inner surface of the outer coupler are assembled and engaged, wherein when the inner coupler and outer coupler are engaged, an interlocking torque transmission structure is established between the inner and outer coupler, and wherein each of the primary and secondary alignment features of the inner coupler and the outer coupler comprises one of a projection and a recess.

Optionally, the primary alignment feature of the inner coupler comprises at least one rib and the primary alignment feature of the outer coupler comprises at least one groove for mating with the at least one rib. The at least one secondary alignment feature of the outer coupler may optionally include a circumferential projection, and the at least one secondary alignment feature of the inner coupler may include at least one circumferential recess that is configured to receive the at least one circumferential projection when the outer coupler and the inner coupler are assembled and engaged. The at least one primary alignment feature of each of the inner coupler and outer coupler may be circumferentially offset from at least one secondary alignment feature in each of the inner coupler and the outer coupler.

The inner coupler may optionally include a collar defining a lip surface, wherein the outer coupler comprises an end surface configured to contact the lip surface such that the collar is positioned adjacent the end surface. The inner coupler may also include a first seating surface extending obliquely between the outer surface and the collar, and the outer coupler may include a second seating surface extending obliquely between the inner surface and the end surface that is configured to mate with the first seating surface.

The at least one primary alignment feature may include a pair of elongated ribs in one of the inner coupler and the outer coupler, and the at least one primary alignment feature may include a pair of elongated grooves in the other one of the inner coupler and the outer coupler. The outer coupler may also include an outer surface including at least one wing formed thereon, wherein the at least one wing is positioned proximate the at least one primary alignment feature.

The inner coupler may include a pair of first transverse openings and the outer coupler may include a pair of second transverse openings, wherein the pair of first transverse openings are aligned with the pair of second transverse openings when the first and second alignment features are mated and wherein the pairs of transverse openings in the inner coupler and the outer couple respectively facilitate a cross-bolt connection of the first and second shafts.

The at least one primary alignment feature and the at least one secondary alignment feature may be differently sized and shaped in each of the inner coupler and the outer coupler. Each of the inner coupler and the outer coupler may include a hollow round body. The at least one primary alignment feature may extend axially on at least one of the inner coupler and the outer coupler, and the at least one secondary alignment feature may extend circumferentially on the other one of the inner coupler and the outer coupler. The coupler assembly may be in combination with the first shaft and the second shaft, wherein at least one of the first shaft and the second shaft is one of a primary pile and an extension piece of a foundation support system.

An embodiment of a shaft assembly has been disclosed including: a first shaft comprising a first distal end; a second shaft comprising a second distal end; an outer coupler extending on the first distal end, the outer coupler formed with at least a first alignment feature comprising a projection or a groove; and an inner coupler extending on the second distal end, the inner coupler comprising at least a second alignment feature that is configured to engage the at least one first alignment feature; wherein when the inner coupler and the outer coupler are partly mated and one of the inner coupler and outer coupler is rotated relative to the other of the inner coupler and the outer coupler, the first alignment feature is self-aligning with the second alignment feature; and wherein the first alignment feature and the second alignment feature are aligned and mated, the inner coupler and the outer coupler are rotationally interlocked with one another to facilitate torque transmission from the first shaft to the second shaft without utilizing a fastener hole in either of the first shaft or the second shaft.

Optionally, the first axial alignment feature comprises at least one groove defined on a round inner surface of the outer coupler, and wherein the second axial alignment feature comprises at least one rib extending from a round outer surface of the inner coupler. The first alignment features and the second alignment features may each extend axially on the inner coupler and the outer coupler. The first axial alignment feature may include a pair of linearly extending grooves located on an inner surface of the outer coupler and opposing one another, and the second alignment feature may include a pair of linearly extending ribs located on an outer surface of the inner coupler. The inner coupler may include a counter bore configured to receive the second distal end of the second shaft, and the outer coupler may include a flange, wherein the flange at least partially defines a cavity configured to receive the first distal end of the first shaft. The inner coupler may include at least one pair of first fastener openings and the outer coupler includes at least one pair of second fastener openings, wherein the pair of first fastener openings are self-aligned with the pair of second fastener openings when the first and second alignment features are mated. The inner coupler may include a first pair and a second pair of fastener holes and the outer coupler includes a first pair and a second pair of fastener holes, the first and second pairs of fastener holes in the outer coupler being self-aligning with the first and second pairs of fastener holes in the inner coupler and facilitating cross-bolt connection of the inner coupler and outer coupler when the inner coupler and outer coupler are fully engaged. At least one of the first shaft and the second shaft may be one of a primary pile and an extension piece of a foundation support system.

An embodiment of a foundation support system has been disclosed comprising: a first foundation element comprising a first shaft having a first distal end and a second end configured to be driven into the ground proximate a building foundation; a second foundation element comprising a second shaft having a second distal end; an outer coupler coupled to one of the first and second distal ends, the outer coupler comprising an inner surface having at least one first alignment feature formed with the inner surface; an inner coupler coupled to the other of the first and second distal ends, the inner coupler comprising an outer surface having at least one second alignment feature, the at least one second alignment feature formed with the outer surface; wherein the outer coupler and the inner coupler are configured to engage in a self-aligning manner via the first alignment feature and the at least one second alignment feature, wherein one of the first alignment feature and the secondary alignment feature comprises a projection and the other of the first alignment feature and the secondary alignment feature comprises a groove.

Optionally, the at least one first alignment feature may include at least one of an axially extending rib and a circumferentially extending groove, and wherein the at least one second alignment feature includes at least one of an axially extending groove and a circumferentially extending tab. The outer coupler may include a body defining a round inner surface including at least one projection and at least one recess angularly offset from one another, wherein the inner coupler comprises a round outer surface including at least one projection and at least one recess angularly offset from one another. Each of the inner coupler and the outer coupler may be configured to facilitate a cross-bolt connection of the inner coupler and the outer coupler. The second foundation element may be an extension piling.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A shaft assembly comprising:

a first shaft comprising a first distal end;

a second shaft comprising a second distal end;

an outer coupler extending on the first distal end, the outer coupler formed with at least a first alignment feature comprising a projection or a groove; and an inner coupler extending on the second distal end, the inner coupler comprising at least a second alignment feature that is configured to engage the at least one first alignment feature;

wherein when the inner coupler and the outer coupler are partly mated and one of the inner coupler and outer coupler is rotated relative to the other of the inner coupler and the outer coupler, the first alignment feature is self-aligning with the second alignment feature; and wherein when the first alignment feature and the second alignment feature are aligned and mated, the inner coupler and the outer coupler are rotationally interlocked with one another to facilitate torque transmission from the first shaft to the second shaft without utilizing a fastener hole in either of the first shaft or the second shaft.

2. The shaft assembly in accordance with claim 1, wherein the first alignment feature comprises at least one groove defined on a round inner surface of the outer coupler, and wherein the second alignment feature comprises at least one rib extending from a round outer surface of the inner coupler.

3. The shaft assembly in accordance with claim 2, wherein the first alignment feature and the second alignment feature each respectively extend axially on the inner coupler and the outer coupler.

4. The shaft assembly in accordance with claim 1, wherein the first alignment feature comprises a pair of linearly extending grooves located on an inner surface of the outer coupler and opposing one another, and wherein the second alignment feature comprises a pair of linearly extending ribs located on an outer surface of the inner coupler.

5. The shaft assembly in accordance with claim 1, wherein the inner coupler comprises a counter bore configured to receive the second distal end of the second shaft.

6. The shaft assembly in accordance with claim 1, wherein the outer coupler comprises a flange, wherein the flange at least partially defines a cavity configured to receive the first distal end of the first shaft.

7. The shaft assembly in accordance with claim 1, wherein the inner coupler comprises at least one pair of first fastener openings and the outer coupler includes at least one pair of second fastener openings, wherein the pair of first fastener openings are self-aligned with the pair of second fastener openings when the first and second alignment features are mated.

8. The shaft assembly in accordance with claim 1, wherein the inner coupler includes a first pair and a second pair of fastener holes and the outer coupler includes a first pair and a second pair of fastener holes, the first and second pairs of fastener holes in the outer coupler being self-aligning with the first and second pairs of fastener holes in the inner coupler and facilitating cross-bolt connection of the inner coupler and outer coupler when the inner coupler and outer coupler are fully engaged.

9. The shaft assembly in accordance with claim 1, wherein at least one of the first shaft and the second shaft is one of a primary pile and an extension piece of a foundation support system.

10. The shaft assembly in accordance with claim 1, wherein the first alignment feature in the outer coupler comprises a primary alignment feature and a secondary alignment feature, and wherein the second alignment feature in the inner coupler comprises a primary alignment feature and a secondary alignment feature.

11. The shaft assembly in accordance with claim 10, wherein the secondary alignment feature of the outer coupler comprises a circumferential projection, and wherein the secondary alignment feature of the inner coupler comprises at least one circumferential recess that is configured to receive the at least one circumferential projection when the outer coupler and the inner coupler are assembled and engaged.

12. The shaft assembly in accordance with claim 10, wherein the primary alignment feature of each of the inner coupler and outer coupler is circumferentially offset from the secondary alignment feature in each of the inner coupler and the outer coupler.

13. The shaft assembly in accordance with claim 1, the inner coupler further comprising a collar comprising a lip surface, the outer coupler further comprising an end surface configured to contact the lip surface such that the collar is positioned adjacent the end surface, the inner coupler further comprising a first seating surface extending obliquely between the outer surface and the collar, and the outer coupler further comprising a second seating surface extending obliquely between the inner surface and the end surface that is configured to mate with the first seating surface.

14. The shaft assembly in accordance with claim 1, wherein the first alignment feature comprises at least one of an axially extending rib or a circumferentially extending groove, and wherein the at least one second alignment feature comprises at least one of an axially extending groove or a circumferentially extending tab.

15. The shaft assembly in accordance with claim 1, wherein the outer coupler comprises a body defining a round inner surface including at least one projection and at least one recess angularly offset from one another, and wherein the inner coupler comprises a round outer surface including at least one projection and at least one recess angularly offset from one another.

16. The shaft assembly in accordance with claim 1, wherein the outer coupler includes a round inner surface, and wherein the first alignment feature comprises at least one axial groove including a seating surface extending obliquely from the round inner surface.

17. The shaft assembly in accordance with claim 16, wherein the outer coupler comprises at least one pair of fastener openings, the at least one pair of first fastener openings being angularly offset from the at least one axial groove.

18. The shaft assembly in accordance with claim 1, wherein the inner coupler includes a round outer surface, and wherein the second alignment feature comprises at least one axial rib including a seating surface extending obliquely from the round outer surface.

19. The shaft assembly in accordance with claim 18, wherein the inner coupler comprises at least one pair of fastener openings, the at least one pair of first fastener openings being angularly offset from the at least one axial rib.

20. The shaft assembly in accordance with claim 1, wherein at least one of the first and second shafts includes a helical auger.

21. The shaft assembly in accordance with claim 20, wherein the helical auger is provided on a modular fitting.

22. The shaft assembly in accordance with claim 21, wherein the modular fitting includes a sleeve coupled to the at least one of the first and second shafts.

23. The shaft assembly in accordance with claim 1, wherein the rotationally interlocked outer coupler and inner coupler completes a mechanical connection between the first shaft and second shaft without utilizing a separately provided fastener.

24. A foundation support system comprising:

a first foundation element comprising a first shaft having a first distal end and a second end configured to be driven into the ground proximate a building foundation;

a second foundation element comprising a second shaft having a second distal end;

an outer coupler coupled to one of the first and second distal ends, the outer coupler comprising an inner surface having at least one first alignment feature formed with the inner surface;

an inner coupler coupled to the other of the first and second distal ends, the inner coupler comprising an outer surface having at least one second alignment feature, the at least one second alignment feature formed with the outer surface;

wherein the outer coupler and the inner coupler are configured to engage in a self-aligning manner via the first alignment feature and the at least one second alignment feature, wherein one of the first alignment feature and the secondary alignment feature comprises a projection and the other of the first alignment feature and the secondary alignment feature comprises a groove.

25. The foundation support system in accordance with claim 24, wherein the at least one first alignment feature comprises at least one of an axially extending rib or a circumferentially extending groove, and wherein the at least one second alignment feature comprises at least one of an axially extending groove or a circumferentially extending tab to mate with the first alignment feature.

26. The foundation support system in accordance with claim 24, wherein the outer coupler comprises a body defining a round inner surface including at least one projection and at least one recess angularly offset from one another, and wherein the inner coupler comprises a round outer surface including at least one projection and at least one recess angularly offset from one another.

27. The foundation support system of claim 24, wherein each of the inner coupler and the outer coupler are configured to facilitate a cross-bolt connection of the inner coupler and the outer coupler.

28. The foundation support system of claim 24, wherein the second foundation element is an extension piling.

29. The foundation support system in accordance with claim 24, wherein when the first alignment feature and the second alignment feature are aligned and mated, the inner coupler and the outer coupler are rotationally interlocked with one another to facilitate torque transmission from the first shaft to the second shaft without utilizing a fastener hole in either of the first foundation element or the second foundation element.

30. The foundation support system in accordance with claim 24, wherein the at least one first alignment feature in the outer coupler comprises a primary alignment feature and a secondary alignment feature, and wherein the at least one second alignment feature in the inner coupler comprises a primary alignment feature and a secondary alignment feature.

31. The foundation support system in accordance with claim 30, wherein the at least one secondary alignment feature of the inner coupler comprises a circumferential projection, and wherein the at least one secondary alignment feature of the outer coupler comprises at least one circumferential recess that is configured to receive the at least one circumferential projection when the outer coupler and the inner coupler are assembled and engaged.

32. The foundation support system in accordance with claim 24, wherein the at least one primary alignment feature of each of the inner coupler and outer coupler is circumferentially offset from at least one secondary alignment feature in each of the inner coupler and the outer coupler.

33. The foundation support system in accordance with claim 24, the inner coupler further comprising a collar comprising a lip surface, the outer coupler further comprising an end surface configured to contact the lip surface such that the collar is positioned adjacent the end surface, the inner coupler further comprising a first seating surface extending obliquely between the outer surface and the collar, and the outer coupler further comprising a second seating surface extending obliquely between the inner surface and the end surface that is configured to mate with the first seating surface.

34. The foundation support system in accordance with claim 24, wherein the first alignment feature includes a seating surface extending obliquely to the inner surface, and wherein the second alignment feature includes a seating surface extending obliquely to the outer surface.

35. The foundation support system in accordance with claim 34, further comprising at least one pair of fastener openings in each respective one of the inner coupler and the outer coupler, wherein the at least one pair of fastener openings is angularly offset from the first alignment feature and the second alignment feature.

36. The foundation support system in accordance with claim 34, wherein the first alignment feature is an axially extending groove and wherein the second alignment feature is an axially extending rib.

37. The foundation support system in accordance with claim 24, wherein at least the first foundation support element includes a helical auger.

38. The foundation support system in accordance with claim 37, wherein the helical auger is provided on a modular fitting.

39. The foundation support system in accordance with claim 38, wherein the modular fitting includes a sleeve coupled to the first shaft.

40. The foundation support system in accordance with claim 24, wherein and interlocking torque transmitting structure is established between the inner coupler and the outer coupler without utilizing a fastener to mechanically couple the first shaft and the second shaft.

41. A foundation support system comprising:

a first foundation support element comprising a first shaft configured to support a building foundation;

a second foundation element comprising a second shaft configured to support the building foundation in combination with the first foundation element; and a coupler assembly configured to interconnect the first foundation element and the second foundation element to support the building foundation, the coupler assembly comprising:

an outer coupler configured to be coupled to one of the first foundation element and the second foundation element, the outer coupler comprising an inner surface formed with at least one primary alignment feature and at least one secondary alignment feature; and an inner coupler configured to be coupled to the other of the first foundation element and the second foundation element, the inner coupler comprising an outer surface formed with at least one primary alignment feature and at least one secondary alignment feature;

wherein the primary and secondary alignment features of the outer coupler are respectively configured to engage the alignment features of the inner coupler when the outer surface of the inner coupler and the inner surface of the outer coupler are assembled and engaged, wherein when the inner coupler and outer coupler are engaged, an interlocking torque transmission structure is established between the inner and outer coupler, and wherein each of the primary and secondary alignment features of the inner coupler and the outer coupler comprises one of a projection and a recess.

42. The foundation support system in accordance with claim 41, wherein the interlocking torque transmission structure is established between the inner and outer coupler without utilizing a fastener hole in either of the first foundation support element or the second foundation support element.

43. The foundation support system in accordance with claim 41, wherein the at least one secondary alignment feature of the outer coupler comprises a circumferential projection, and wherein the at least one secondary alignment feature of the inner coupler comprises at least one circumferential recess that is configured to receive the at least one circumferential projection when the outer coupler and the inner coupler are assembled and engaged.

44. The foundation support system in accordance with claim 41, wherein the at least one primary alignment feature of each of the inner coupler and outer coupler is circumferentially offset from at least one secondary alignment feature in each of the inner coupler and the outer coupler.

45. The foundation support system in accordance with claim 41, the inner coupler further comprising a collar comprising a lip surface, the outer coupler further comprising an end surface configured to contact the lip surface such that the collar is positioned adjacent the end surface, the inner coupler further comprising a first seating surface extending obliquely between the outer surface and the collar, and the outer coupler further comprising a second seating surface extending obliquely between the inner surface and the end surface that is configured to mate with the first seating surface.

46. The foundation support system in accordance with claim 41, wherein each of the inner coupler and the outer coupler are configured to facilitate a cross-bolt connection of the inner coupler and the outer coupler.

47. The foundation support system in accordance with claim 41, wherein in the respective outer and inner couplers the primary alignment feature comprises at least one of an axially extending rib and a circumferentially extending groove, and wherein the at least one secondary alignment feature comprises at least one of an axially extending groove and a circumferentially extending tab.

48. The foundation support system in accordance with claim 41, wherein the outer coupler comprises a body defining a round inner surface including at least one projection and at least one recess angularly offset from one another, and wherein the inner coupler comprises a round outer surface including at least one projection and at least one recess angularly offset from one another.

49. The foundation support system in accordance with claim 41, wherein at least one of the first foundation support element and the second foundation support element includes a helical auger.

50. The foundation support system in accordance with claim 49, wherein the helical auger is provided on a modular fitting.

51. The foundation support system in accordance with claim 50, wherein the modular fitting includes a sleeve coupled to the at least one of the first shaft and second shaft.

52. The foundation support system in accordance with claim 41, wherein the interlocking torque transmitting structure is established without utilizing a fastener to mechanically couple the first shaft and the second shaft.

53. A coupled shaft assembly for a foundation support system comprising:

a first foundation support shaft having a first distal end and a first coupler at the first distal end;

a second foundation support shaft having a second distal end and a second coupler at the second distal end;

wherein each of the first coupler and the second coupler comprises at least one primary alignment and torque transmitting feature that are engageable in a self-aligning manner when the first coupler and the second coupler are partly mated;

wherein the at least one primary alignment and torque transmitting feature in the respective first and second couplers comprises one of an axially extending elongated projection or an axially extending elongated groove proximate the first distal end or the second distal end, and wherein when the axially extending elongated projection is received in the axially extending elongated groove, an interlocking torque transmission structure is established between the first distal end of the first shaft and the second distal end of the second shaft.

54. The coupled shaft assembly in accordance with claim 53, wherein the first coupler includes a first body and the second coupler includes a second body, wherein the axially extending elongated projection includes a first seating surface on a first end thereof and extending obliquely to the first body, and wherein the axially extending elongated groove includes a second seating surface on a second end thereof and extending obliquely to the second body.

55. The coupled shaft assembly in accordance with claim 54, wherein the first coupler includes a round inner surface and wherein the second coupler includes a round outer surface, each of the first seating surface and the second seating surface respectively extending obliquely to one of the round inner surface and the round outer surface.

56. The coupled shaft assembly in accordance with claim 54, wherein the first and second seating surface are engaged to one another when the axially extending elongated projection is received in the axially extending elongated groove.

57. The coupled shaft assembly in accordance with claim 53, wherein the first coupler and second coupler each include self-aligning fastener openings when the axially extending elongated projection is received in the axially extending elongated groove.

58. The coupled shaft assembly in accordance with claim 57, wherein the self-aligning fastener openings in each of the first and second coupler include a first pair of fastener openings and a second pair of fastener openings positioned transversely to the first pair of fastener openings to facilitate a cross-bolt connection.

59. The coupled shaft assembly in accordance with claim 53, wherein the self-aligning fastener openings are angularly offset from each of the at least one primary alignment and torque transmitting feature in the respective first and second couplers.

60. The coupled shaft assembly in accordance with claim 53, wherein at least one of the first foundation support element and the second foundation support element includes a helical auger.

61. The coupled shaft assembly in accordance with claim 60, wherein the helical auger is provided on a modular fitting.

62. The coupled shaft assembly in accordance with claim 61, wherein the modular fitting includes a sleeve coupled to the at least one of the first shaft and second shaft.

63. The coupled shaft assembly in accordance with claim 53, wherein the interlocking torque transmitting structure is established between the first distal end of the first shaft and the second distal end of the second shaft without utilizing a fastener to mechanically couple the first shaft and the second shaft.

* * * * *